US009782047B2

(12) United States Patent
Nieschwitz et al.

(10) Patent No.: US 9,782,047 B2
(45) Date of Patent: Oct. 10, 2017

(54) VACUUM TUBE LOCKING COLLAR

(71) Applicant: H-P Products, Inc., Louisville, OH (US)

(72) Inventors: Darrell V. Nieschwitz, Louisville, OH (US); Shawn C. Metz, Louisville, OH (US)

(73) Assignee: H-P Products, Inc., Louisville, OH (US)

( * ) Notice: Subject to any disclaimer, the term of this patent is extended or adjusted under 35 U.S.C. 154(b) by 386 days.

(21) Appl. No.: 14/570,159

(22) Filed: Dec. 15, 2014

(65) Prior Publication Data

US 2015/0190023 A1 Jul. 9, 2015

Related U.S. Application Data

(60) Provisional application No. 61/923,949, filed on Jan. 6, 2014.

(51) Int. Cl.

| | |
|---|---|
| ***A47L 5/38*** | (2006.01) |
| ***A47L 9/28*** | (2006.01) |
| ***A47L 9/00*** | (2006.01) |
| ***A47L 9/24*** | (2006.01) |

(52) U.S. Cl.

CPC ..... *A47L 5/38* (2013.01); *A47L 9/0009* (2013.01); *A47L 9/244* (2013.01); *A47L 9/2857* (2013.01)

(58) Field of Classification Search

CPC ..... A47L 5/38; A47L 9/2857; A47L 9/0009; A47L 9/244

See application file for complete search history.

(56) References Cited

U.S. PATENT DOCUMENTS

| | | | | |
|---|---|---|---|---|
| 2,953,806 | A | 7/1958 | Walker | |
| 2,943,698 | A | 7/1960 | Bishop | |
| 3,173,164 | A | 3/1965 | Congdon | |
| 3,520,725 | A | 7/1970 | Hamrick | |
| 4,050,113 | A | 9/1977 | Wright et al. | |
| 4,336,427 | A | 6/1982 | Lindsay | |
| 6,459,056 | B1 | 10/2002 | Graham | |
| 7,010,829 | B2 * | 3/2006 | Harman | A47L 5/38 15/314 |
| 7,624,472 | B2 | 12/2009 | Ambrose | |
| 7,945,990 | B2 | 5/2011 | Gabric et al. | |
| 8,001,650 | B2 | 8/2011 | Trotter | |
| 8,479,353 | B2 | 7/2013 | Drivstuen et al. | |
| 8,590,098 | B2 | 11/2013 | Smith et al. | |

* cited by examiner

*Primary Examiner* — Robert Scruggs
(74) *Attorney, Agent, or Firm* — Sand & Sebolt

(57) ABSTRACT

A central vacuum cleaning system includes a locking collar mounted at various locations in a structure or RV and connected to the inlet end of a vacuum conduit. A section of hose is slidably mounted within the conduit and extends therefrom for cleaning an adjacent area. A pair of O-rings within the collar frictionally retains a handle mounted on the end of the hose in a stored position when the hose is in a retracted position and provides an air seal between the handle and vacuum supply conduit. A locking mechanism mounted on the collar automatically locks the hose in a selected extended position when manually pulled from the collar by a locking finger engaging an adjacent section of the hose. An electric switch on the collar enables a user to actuate the vacuum supply source. A mounting bracket enables the collar to be mounted at various locations in the structure and a ring formed on the collar enables the collar to be rotated to a desired position on the mounting bracket.

21 Claims, 19 Drawing Sheets

112
108
110
26
20,24
SEE FIG-13
117
33
109
45
53
25
78
102
103
130
129
54
47
55
43
73
100
101
49
123
41
89
69
86
39
124
51
107
70,97
57
96
104
59
22
106
67
116
105
63
126
79
75
64
76
61,65
80
37
66
87
29
91
35
31
92
9
16

VACUUM TUBE LOCKING COLLAR

CROSS-REFERENCE TO RELATED APPLICATION

This application claims priority from U.S. Provisional Application Ser. No. 61/923,949, filed Jan. 6, 2014, the disclosure of which is incorporated herein by reference.

BACKGROUND OF THE INVENTION

Technical Field

The invention relates to a vacuum cleaning system, and in particular, to a collar which can be mounted on a structure in a variety of positions and connected to the inlet end of a vacuum conduit providing a storage cradle for holding the handle of a vacuum cleaning hose slidably mounted within the conduit when the hose is in a retracted position within the conduit, and which provides a locking mechanism for releasably securing the hose in an extended condition from the conduit. Seals are provided to enable the collar to be used in multiple outlet cleaning systems.

Background Information

Central vacuum systems for home and commercial use have been used for many years, examples of which are shown in U.S. Pat. Nos. 2,943,698 and 3,173,164. These systems generally are comprised of a main vacuum source which is usually mounted in the basement or other locations in the structure or closely adjacent thereto. The vacuum source is connected to various dedicated inlet valves in the structure by conduits or tubing. These valves are mounted in a wall, inside of a cabinet or in and on other structures.

More recently, many of these vacuum systems use a hose that is slidably contained within the vacuum conduit and expandable therefrom, so that the hose is pulled from the conduit for cleaning an area and then retracted back into the vacuum conduit for storage after use. Some examples of such systems are shown in U.S. Pat. Nos. 2,953,806, 7,010,829, and 8,001,650. These systems have a handle which is attached to the end of the hose which is retained in or stored closely adjacent to an in-wall valve or other type of supporting bracket or cradle when not in use, such as shown in the above-mentioned patents. Also, some of these prior art systems are provided with some type of locking mechanism to secure the hose in an extended position such as shown by the manually actuated locking mechanism of U.S. Pat. No. 7,010,829 and a wire loop or an external locking loop as shown in U.S. Pat. No. 8,590,098.

Central vacuum cleaning systems also are becoming popular in recreational vehicles and camping trailers. However, one problem is that space is very limited and it is difficult to install the rigid type of vacuum supply conduits as used in most residential and commercial buildings. Furthermore, storage space for the cleaning hose and wand attached to the inlet end thereof is at a premium in these RVs. Also it is difficult to find an area within the RV to secure the handle when not in use as well as sealing the inlet end of the conduit when used in multiple vacuum inlets within the RV.

Although prior art pneumatic systems for structures and RVs with an associated locking mechanism perform satisfactory, they require numerous components and are difficult to mount in a variety of locations and on available structures.

SUMMARY

In one aspect, the invention may provide a central vacuum cleaning system comprising: a vacuum source; a vacuum conduit extending from the vacuum source to an inlet end; a hose slidably mounted within the conduit and extendable from a retracted position to an extended position having a first end operatively communicating with the vacuum source and a second end extendable from the inlet end of the conduit for collecting debris from an area to be cleaned; a handle on the second end of the hose; a collar adapted to be mounted on a supporting structure at the inlet end of the conduit and connected to the vacuum conduit permitting passage of the hose therethrough and for holding the handle in a stored position when the hose is in the retracted position; a locking mechanism on the collar permitting the hose to move freely toward the extended position through the collar while preventing movement of the hose toward the retracted position until manually actuated by a user; and a clamp mechanism adjustably mounting the collar on the support structure at the inlet end of the conduit.

In another aspect, the invention may provide a collar adapted to be mounted on a structure and connected to a terminal end of a conduit of a vacuum cleaning system comprising: a body formed with a through bore with inner and outer open ends, said inner open end adapted to communicate with the conduit and the outer end adapted to receive a handle attached to an end of a hose expandable from and retractable within the conduit when the handle is in a stored position in the collar; a locking mechanism on the body including a locking member extending into the bore for automatically engaging the hose to maintain the hose in an extended position until manually released to permit the hose to return to a retracted position within the conduit; a seal within the body adapted to provide an air seal between the handle and collar when the handle is in the stored position; an annular ring formed on and extending at least partially around the body; and a pair of clamp members engageable with the ring for rotatably mounting the body on the clamp members and for mounting the collar on a support structure.

BRIEF DESCRIPTION OF THE SEVERAL VIEWS OF THE DRAWINGS

A sample embodiment of the invention is set forth in the following description, is shown in the drawings and is particularly and distinctly pointed out and set forth in the appended claims.

Similar numbers refer to similar parts throughout the drawings.

DETAILED DESCRIPTION

Figure 1:
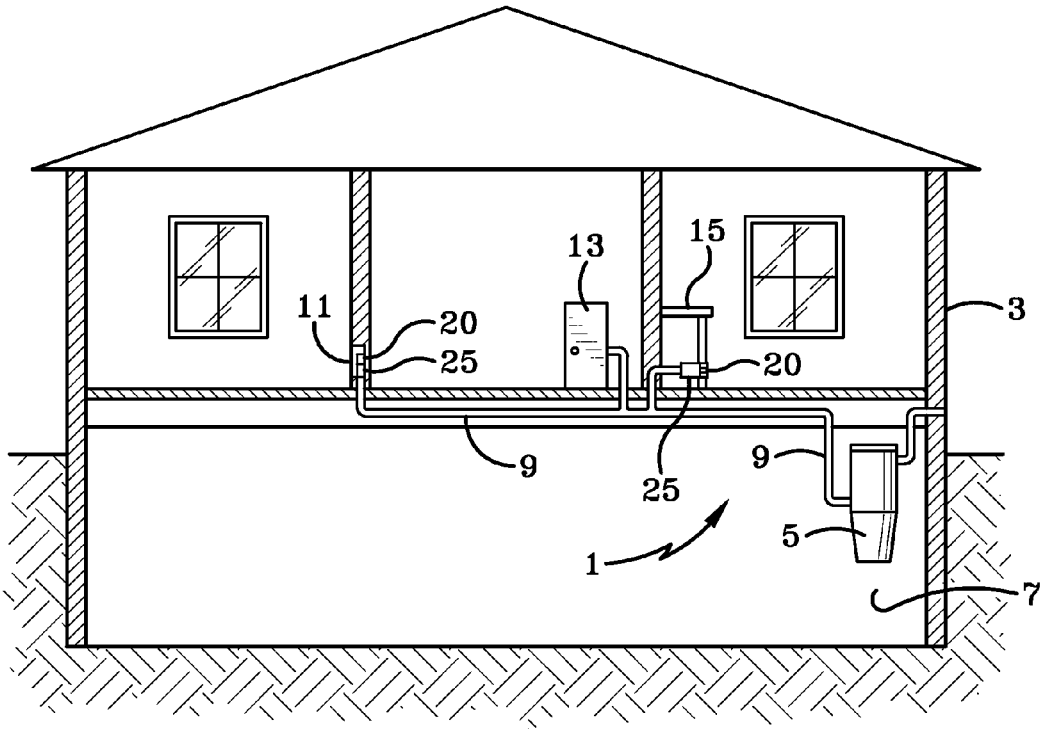
FIG. 1 is a diagrammatic view showing a structure having a central vacuum source in the lower level thereof connected to three different inlet locations within the structure.

One example of a central vacuum cleaning system in which the locking collar of the present invention is incorporated is indicated generally at 1, and is shown in FIG. 1 mounted within a usual structure 3. A central vacuum source 5 is located within the structure such as in a lower level 7. However, it could be located at other locations in the structure or outside closely adjacent thereto. A plurality of vacuum source tubes or conduits 9 extend from vacuum source 5 to various locations or rooms within structure 3. The number of conduits will depend upon the size of the house, number of rooms, size of vacuum source 5, and other factors. These vacuum supply conduits are usually formed of rigid plastic and terminate at various inlet locations in the structure, three of which are shown in FIG. 1. One of the supply conduits terminates at a usual wall valve 11, whereas another supply conduit terminates in a wall storage cabinet 13, with another supply conduit terminating under a counter 15. It is also readily understood that various conduits could extend into the garage, workshop or at other locations for mounting without effecting the concept of the invention.

Figure 1A:
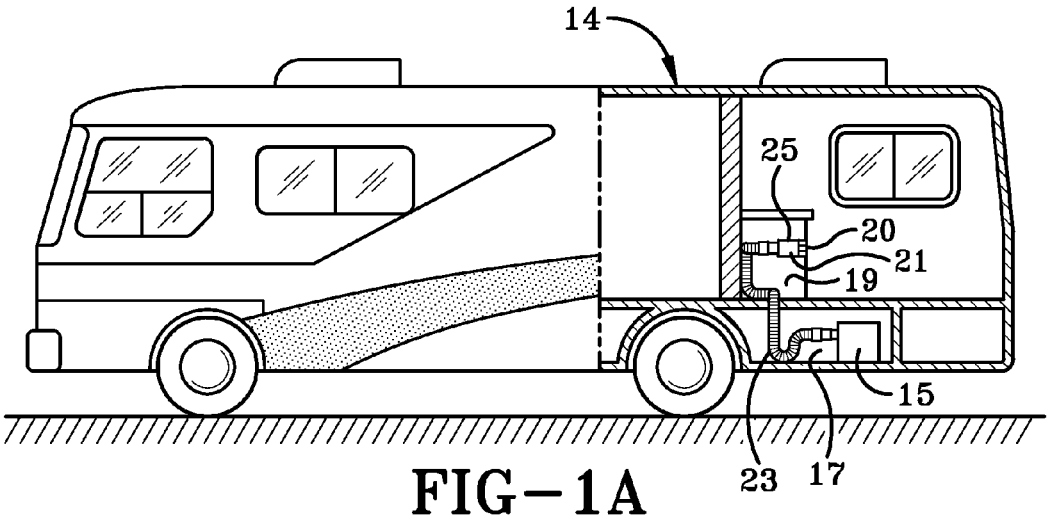
FIG. 1A is a diagrammatic view showing the central vacuum cleaning system and locking collar of the present invention mounted within a recreational vehicle.

FIG. 1A illustrates the improved vacuum tube locking collar and vacuum cleaning system installed in a recreational vehicle (RV) 14. The system will include a usual vacuum power supply 15 located in a storage area 17 and an inlet 21 located in a cabinet 19 or other easily accessible location within the RV. Preferably in an RV the vacuum supply conduit will be a flexible hose 23 in place of rigid conduits 9 enabling it to be installed to conform to the available space and contours of an RV when space is at a premium. Although FIG. 1A shows only a single inlet 21, it is readily understood that the RV can have multiple inlets throughout the vehicle all connected to vacuum source 15.

Figure 12:
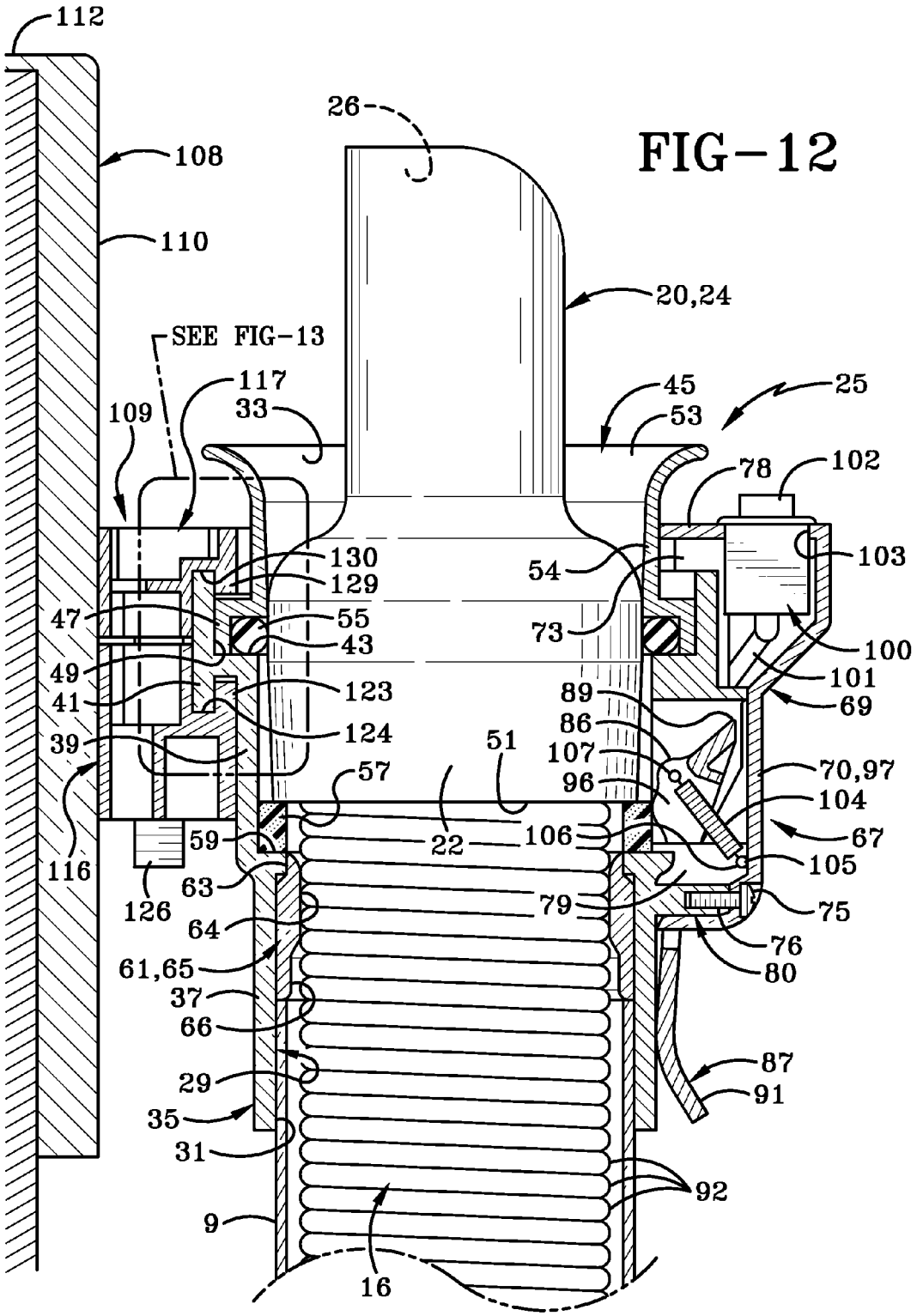
FIG. 12 is an enlarged sectional view taken along line 12-12, FIG. 8.
Figure 13:
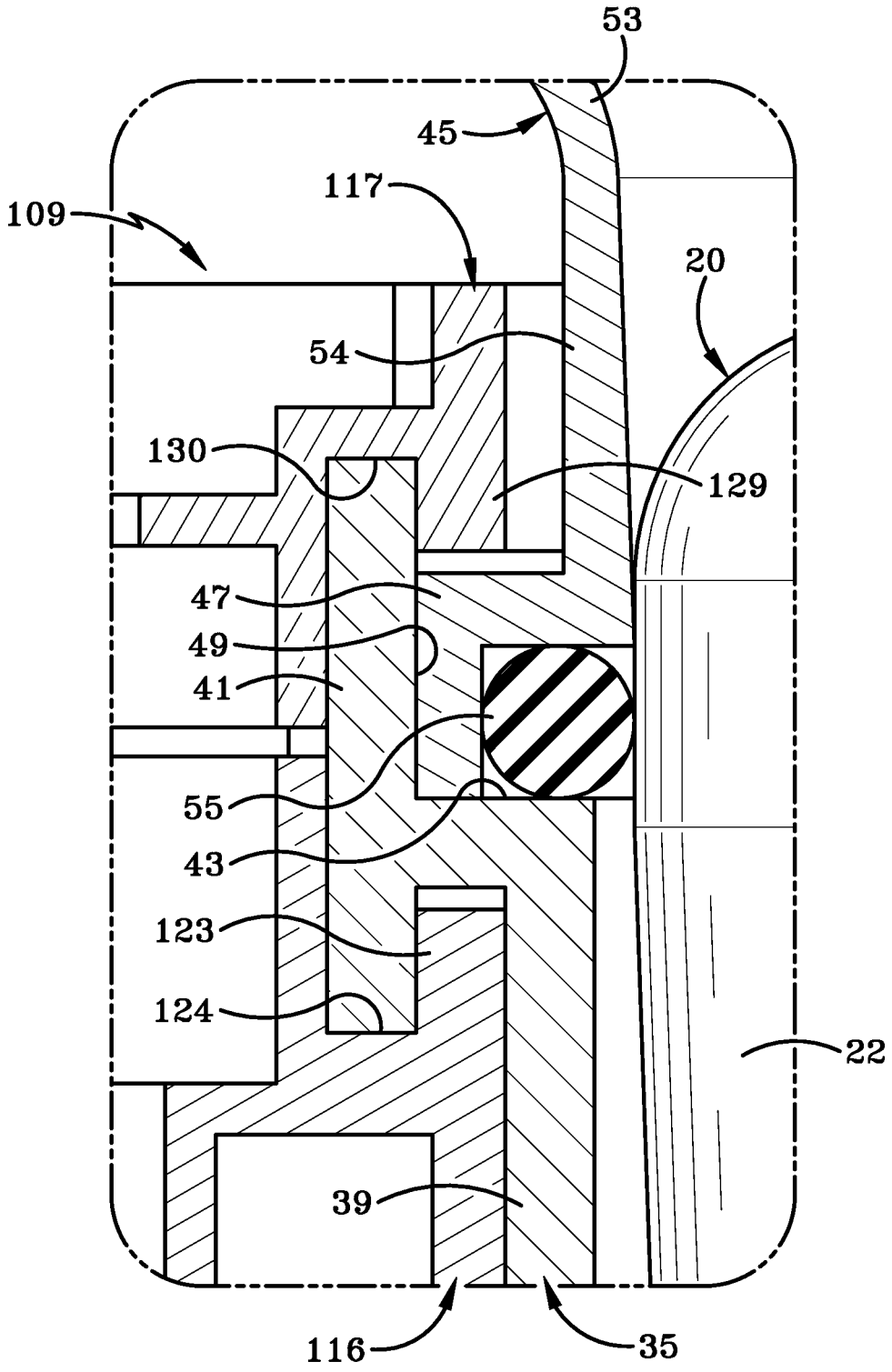
FIG. 13 is an enlarged view of the encircled portion in FIG. 12.
Figure 14:
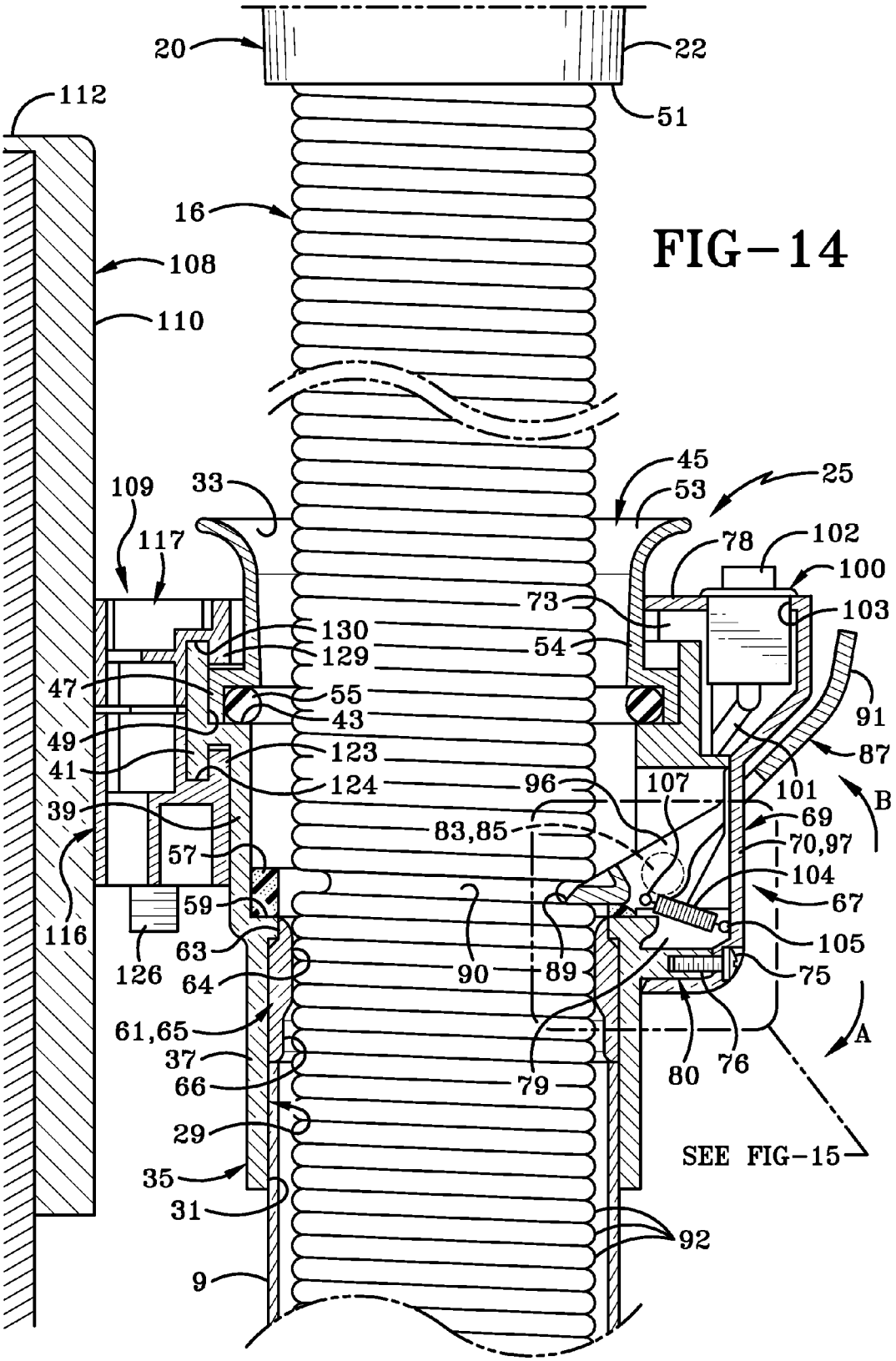
FIG. 14 is a view similar to FIG. 12 showing the locking finger in locking engagement with the retractable hose when the hose is in a partially extended position.

As shown in FIGS. 2A, 3, 4B, 12, 14, 15, and 16, a section of a hose 16 will be contained within each of the conduits 9 and 23 and will have a handle 20 attached to the outer end for grasping by an operator for cleaning an adjacent area. The unique collar of the present invention is indicated generally at 25, and the main components thereof are shown in detail in FIGS. 4A, 4B, and 4C. Collar 25 preferably is molded of plastic, although it could be formed of metal without affecting the concept of the invention. Collar 25 is formed with a through bore or passage 29 which terminates in an open inner end 31 and an open outer end 33 (FIGS. 12 and 14). Collar 25 includes a main body 35 which has a cylindrical end section 37 and a larger diameter cylindrical central section 39 which terminates in an annular upper ring 41 connected to central section 39 by an annular shoulder 43.

An annular end section or collar, indicated generally at 45 (FIGS. 4C and 12), terminates in an inner right angle shoulder 47 which is slidably received within and against the inside surface 49 of annular ring 41 and sets upon annular shoulder 43 of central section 39. Shoulder 43 is formed at the junction of the upper portion of annular ring 41 and the top end of central section 39. End collar 45 terminates in an outwardly flared end flange 53 which guides the handle 20 into the collar body when the hose is moving toward a stored position. Flange 53 forms the open outer end 33 of the locking collar and has a smooth inner cylindrical wall 54 which forms a through bore of end collar 45.

An O-ring 55, formed of a rubber or some type of resilient material, is located between step shoulder 47 of end collar 45 and annular shoulder 43 of central section 39. Ring 55 has an inner diameter generally complementary to the inner diameter of end collar 45 and provides a frictional sliding fit with handle 20 to assist in retaining handle 20 within body 35 when in its stored position. A sealing ring 57 formed of rubber or a foam type of material is seated upon an annular shoulder 59 formed between central section 39 and cylindrical end section 37. Ring 57 provides an air seal with the annular bottom edge 51 of handle 20 when the handle is in its stored position as shown in FIG. 12.

An annular hose stop, indicated generally at 61 (FIGS. 4A, 12 and 17), terminates in an inwardly curved upper shoulder 63 and a main cylindrical body 65 which terminates in a larger diameter section 66 and a smaller internal diameter 64. Hose stop 61, as shown particularly in FIG. 12, is slidably received in the internal diameter of cylindrical end section 37 with the stepped upper shoulder 63 engaging shoulder 59 to properly position stop 61 within the interior of end section 37.

Figure 4A:
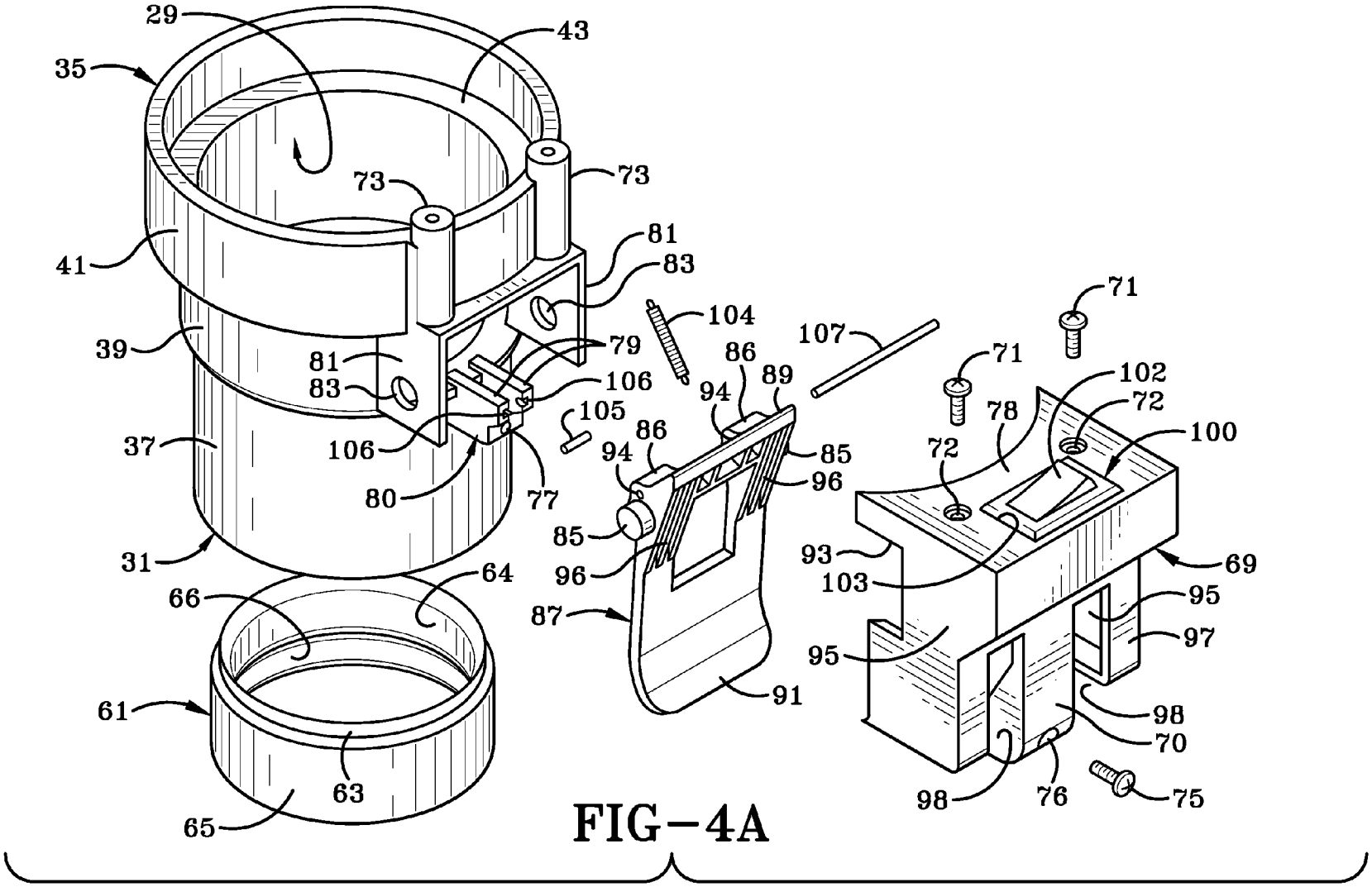
FIG. 4A is an exploded perspective view showing the lock housing, locking mechanism and hose stop components of the locking collar.

In accordance with another feature of the invention, a locking mechanism indicated generally at 67, is mounted on main collar body 35 (FIG. 4A). Locking mechanism 67 includes a lock housing 69 which is mounted on the exterior of body 35 by a pair of fasteners 71 which extend through a pair of holes 72 formed in top wall 78 and threadably engage a pair of spaced posts 73 formed integrally with annular ring 41, and by another fastener 75 which extends through a hole 76 formed in a central post 70 of lock housing 69. Fastener 75 is engaged within an opening 77 formed in the lower end of a stud 80 having a pair of spaced members 79 formed integrally with and projecting outwardly on stud 80 of central section 39.

Locking mechanism 67 furthermore includes a pair of spaced flanges 81 which are formed integrally with and extend outwardly from central section 39 of body 35. Each flange 81 is formed with a hole 83 which snap fittedly receives a pair of bosses 85 which are formed on and extend outwardly from the ends of a locking member or finger indicated generally at 87. Locking member 87 terminates in a laterally extending locking edge 89 and an opposite finger tab 91.

Figure 5:
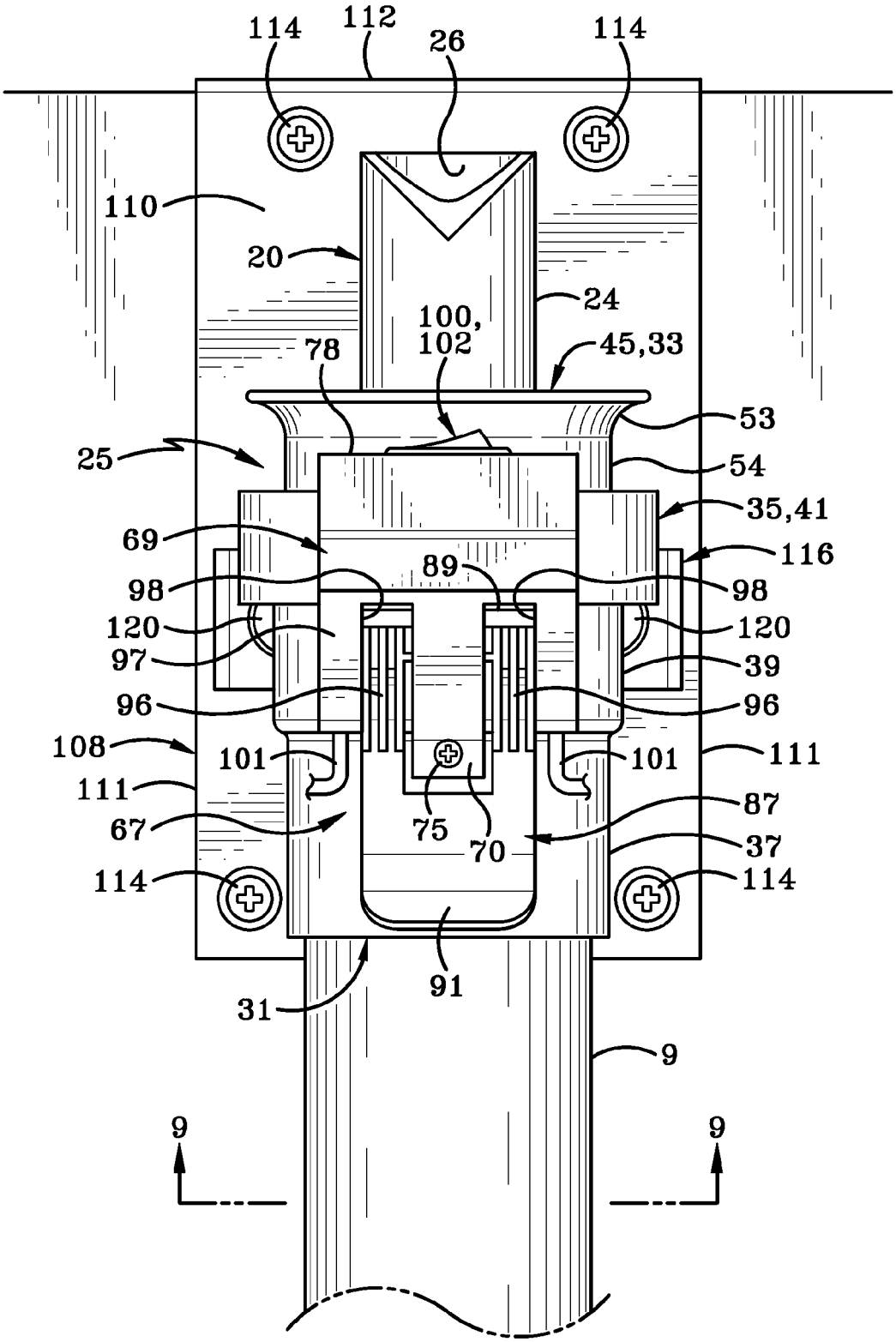
FIG. 5 is a front elevational view of the locking collar and handle with a rigid outer conduit as shown in FIG. 1, with the locking finger in the unlocked position.
Figure 6:
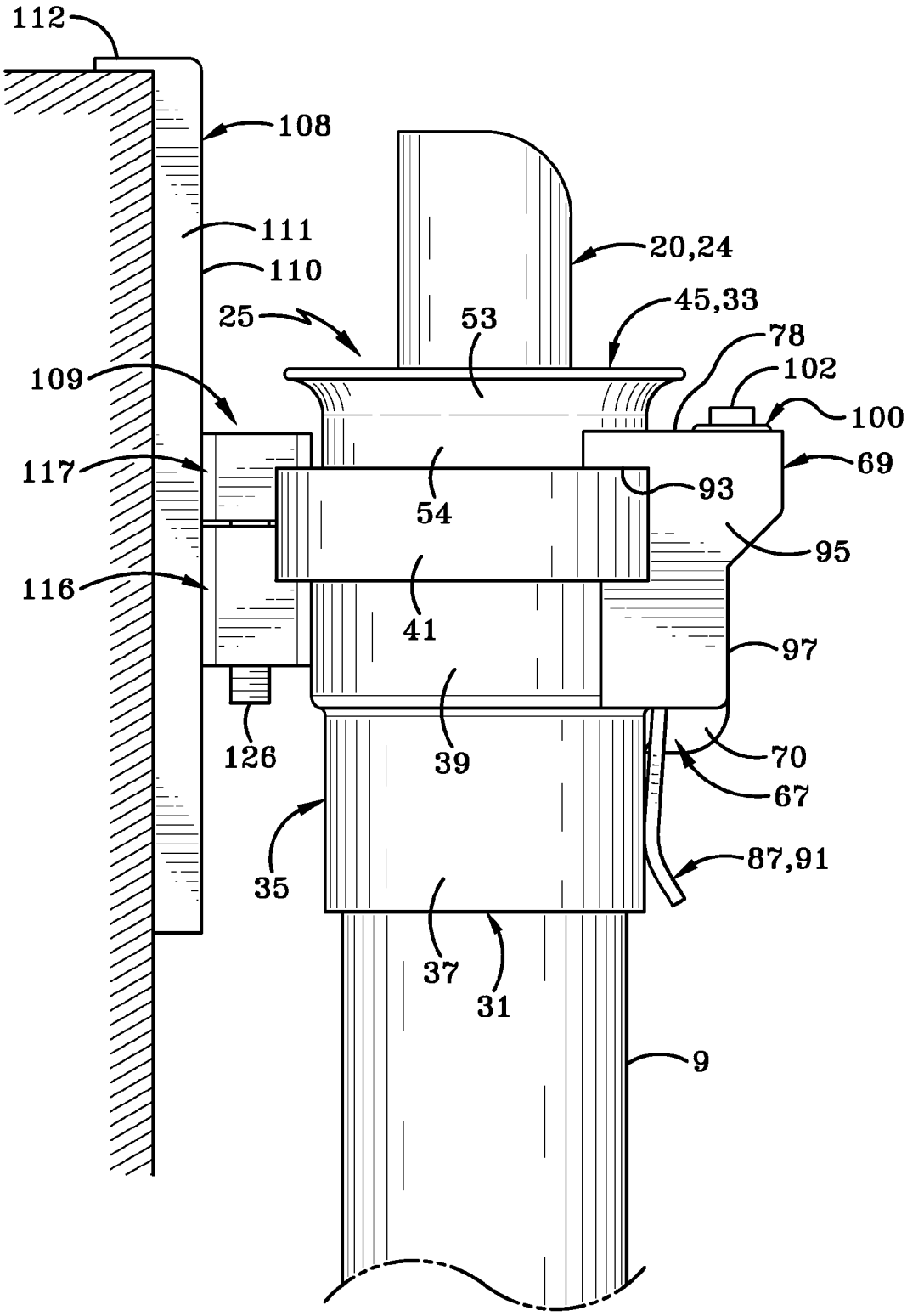
FIG. 6 is a left side elevational view of the locking collar as shown in FIG. 5.

Lock housing 69 is formed with a pair of cut-outs 93 in side walls 95 thereof which receive annular ring 41 therein when mounted on body 35 as best shown in FIG. 6. Rear wall 97 of lock housing 69 is formed with a pair of cut-outs 98 adjacent central post 70 through which spaced portions 96 of locking finger 87 extend when lock housing 69 is secured to main body 35 enabling locking finger 87 and in particular finger tab 91 thereof, to extend externally of lock housing 69 as shown in FIGS. 5 and 6.

In further accordance with the invention, an electric switch 100 is mounted within lock housing 69 and is adapted to be connected to vacuum sources 5 and 15 by electrical conductors or wires 101. Switch 100 includes an actuation toggle button 102 which extends through an opening 103 formed in a top wall 78 of housing 69.

Figure 15:
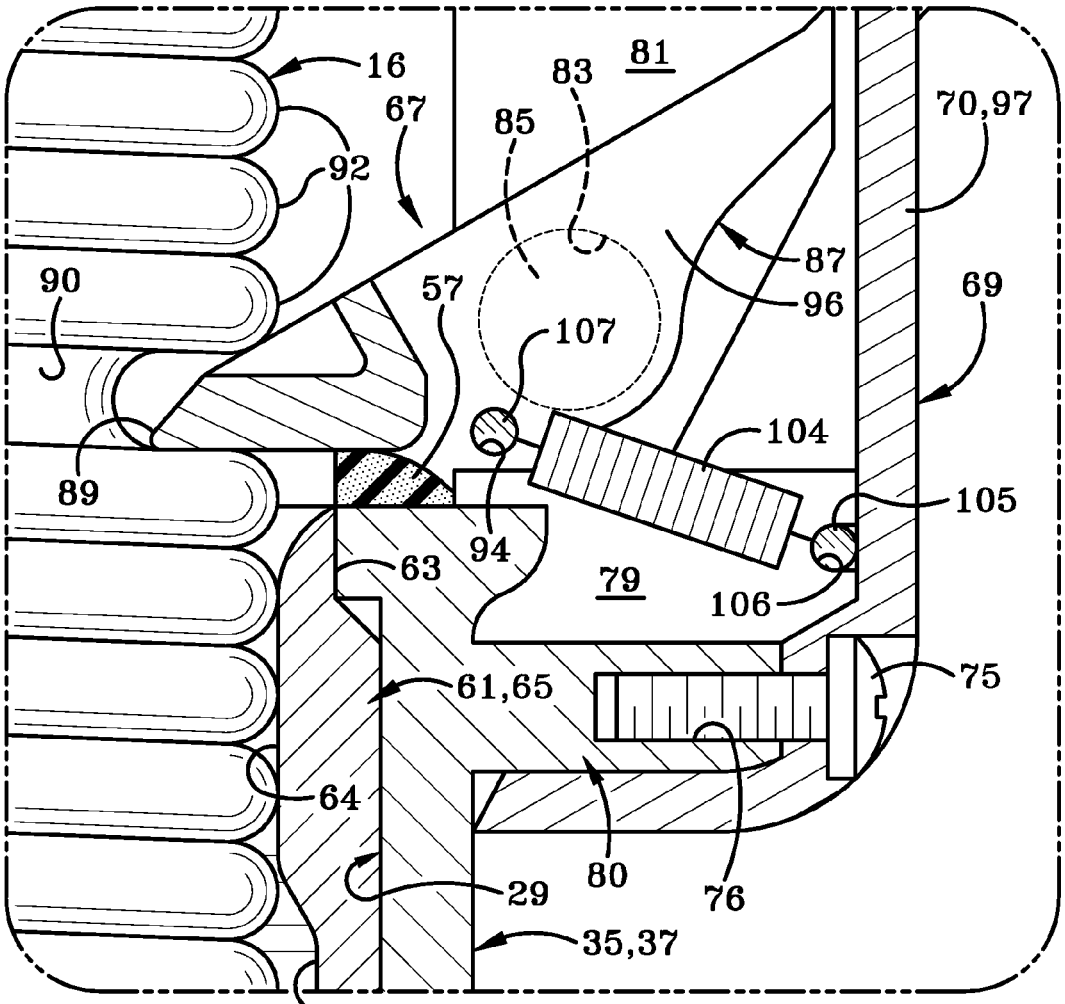
FIG. 15 is an enlarged fragmentary view of the encircled portion of FIG. 12 showing the locking finger engaged with the cleaning hose.
Figure 16:
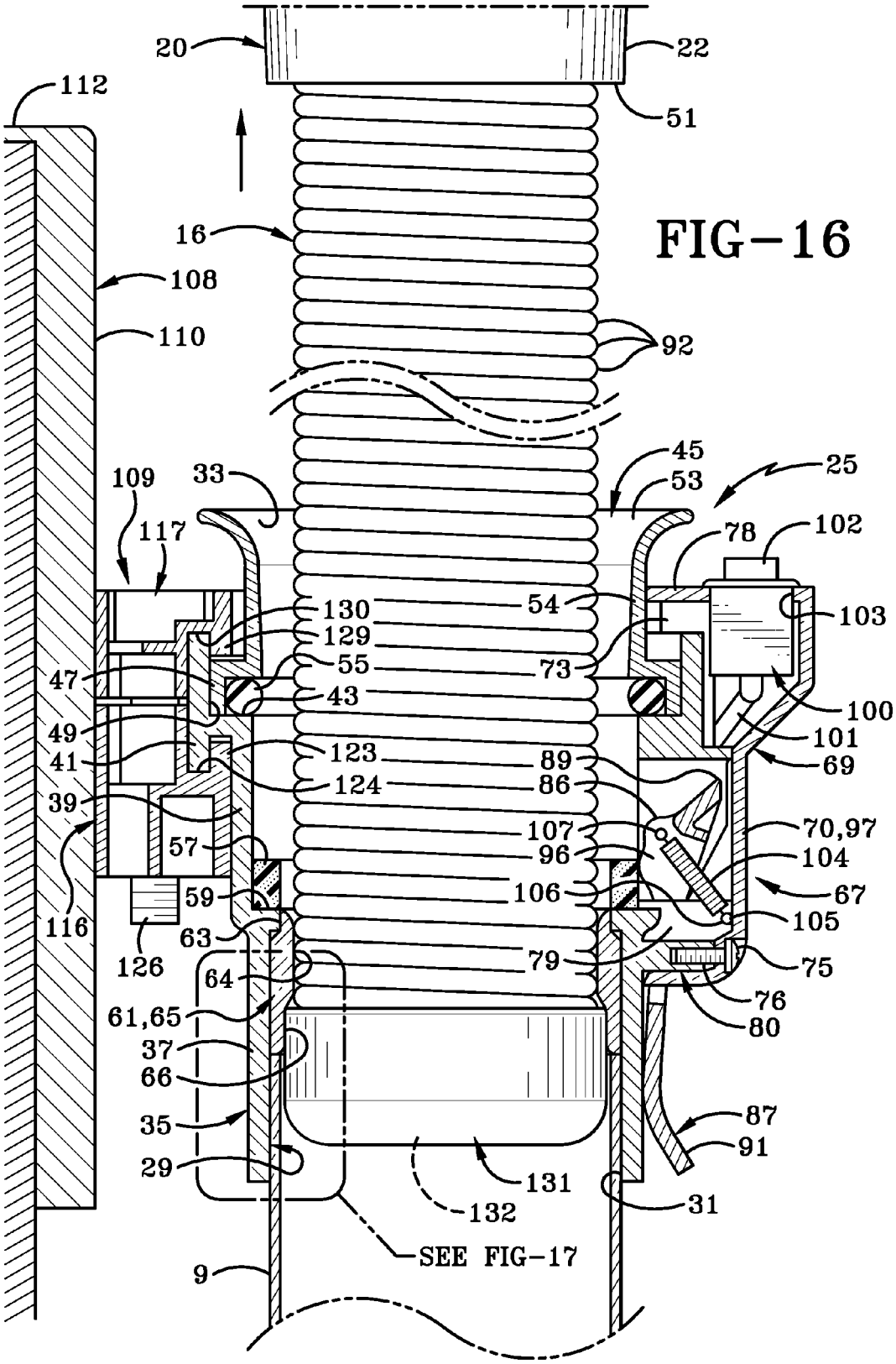
FIG. 16 is a view similar to FIG. 14 with the locking finger in its unlocked, retracted position.

Locking finger 87 is spring biased by a spring 104 toward a locking position when it is engaged with hose 16 as shown in FIG. 14 and toward an unlocked retracted position as shown in FIG. 16. Spring 104 extends between a pin 105 which is mounted within a pair of notches 106 formed at the outer ends of studs 79 (FIGS. 4A and 12) and at the opposite end to a pin 107 slidably received through a pair of openings 94 formed in a pair of lugs 86 formed on and extending outwardly on locking finger 87 generally adjacent locking edge 89. Spring 104 when in a first position biases locking edge 89 toward locking engagement with hose 16 as shown in FIGS. 14 and 15 and biases the locking finger into an unlocked disengaged position as shown in FIG. 16.

Figure 4B:
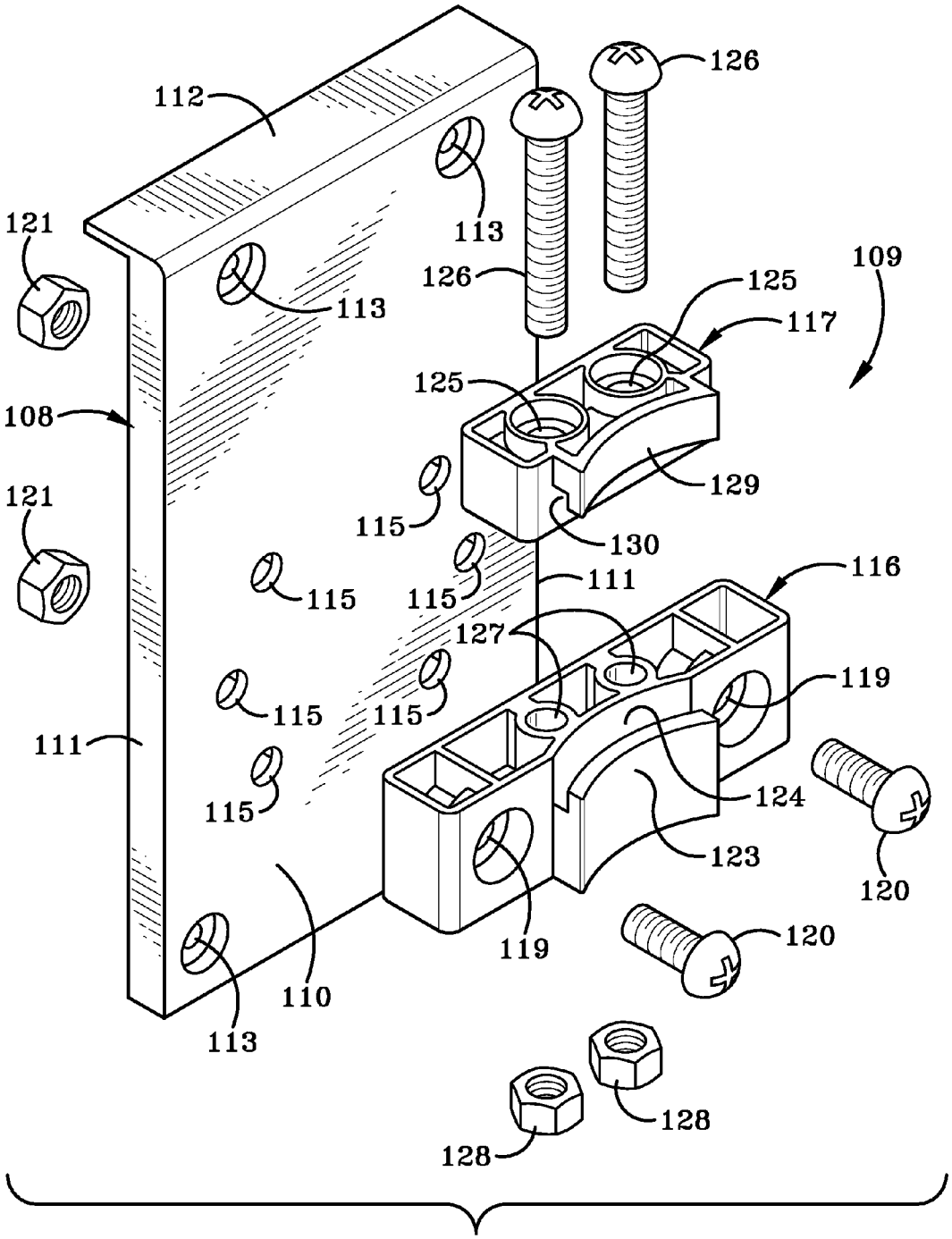
FIG. 4B is an enlarged exploded perspective view showing the collar mounting clamps and collar support bracket.
Figure 4C:
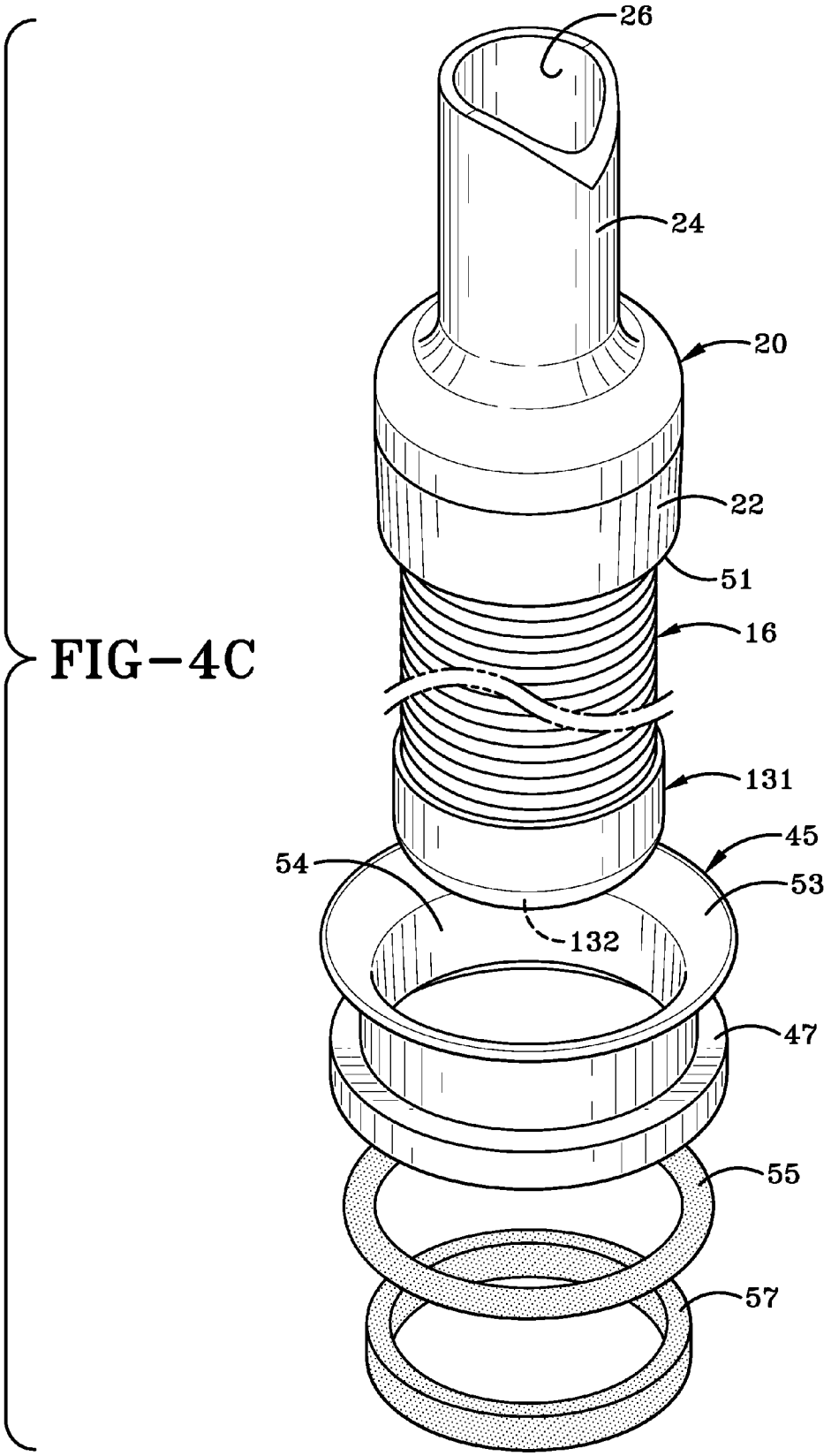
FIG. 4C is a fragmentary exploded view of the handle and internal hose in combination with the sealing rings and flared end component of the locking collar.

In accordance with another feature of the invention, locking collar 25 includes a mounting bracket indicated generally at 108 (FIGS. 4B and 7) and a clamp mechanism indicated generally at 109, for adjustably mounting body 35 onto bracket 108. Mounting bracket 108 includes a flat plate 110 formed with a pair of right angled side flanges 111 and a top ledge 112 which extends outwardly beyond end flanges 111. Four mounting holes 113 are formed generally adjacent the four corners of plate 110 for receiving fasteners (not shown) for securing bracket 108 to a supporting structure. Holes 113 can be counter-bored as shown in FIG. 4B so that the fastener heads are generally flush with the surface of plate 110 when bracket 108 is secured to a supporting structure.

Figure 7:
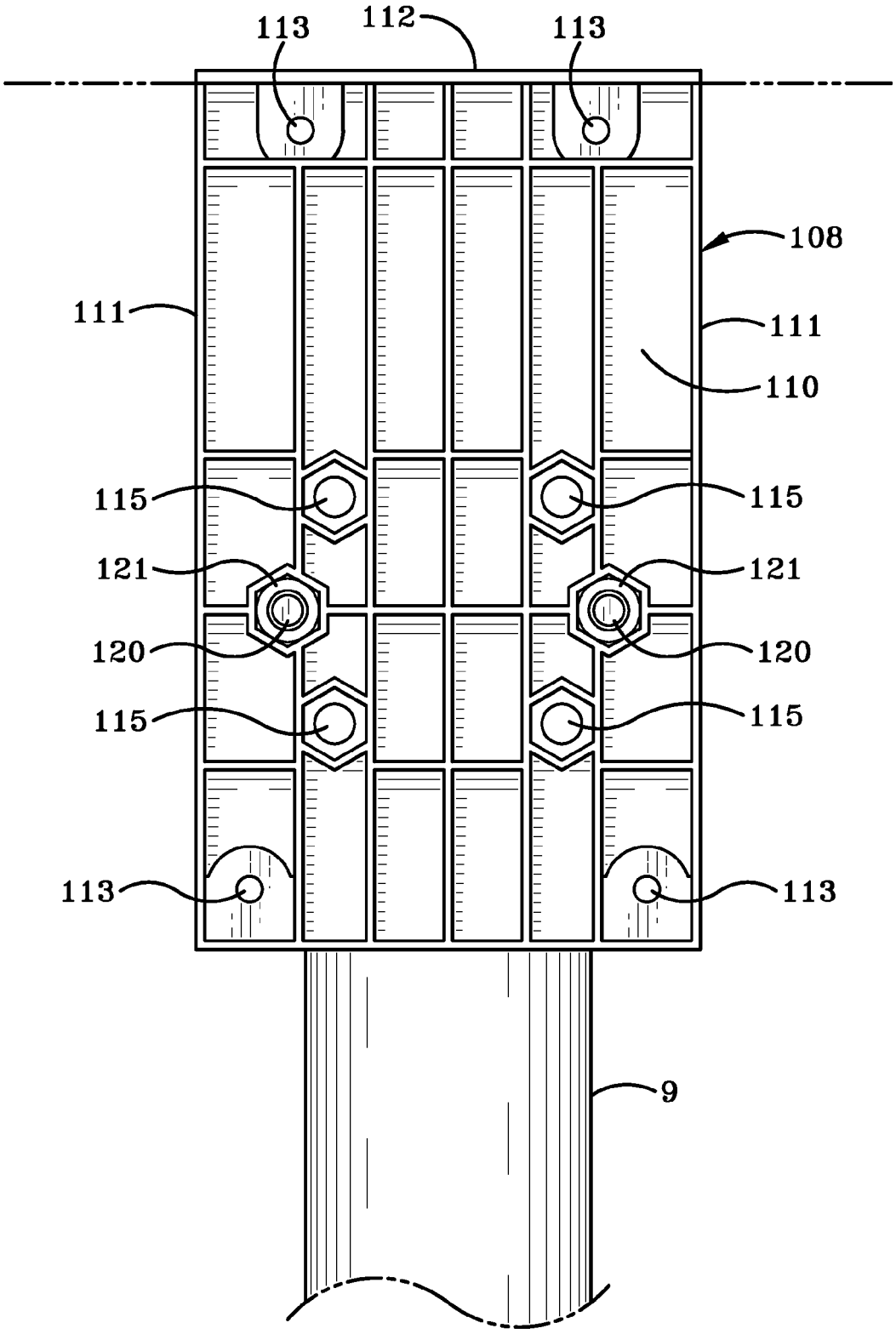
FIG. 7 is a rear elevational view of the mounting bracket attached to the locking collar.

A plurality of holes 115, six are shown in the drawings, are formed through plate 110 for adjustably mounting a pair of clamp members 116 and 117 thereon as discussed below which form clamp mechanism 109. Clamp members 116 and 117 have a generally rectangular configuration with bottom clamp 116 being formed with a pair of holes 119 for receiving a pair of fasteners 120 which project through a selected pair of holes 115 formed in plate 110 and secured thereon by a pair of nuts 121 as shown in FIGS. 4B and 7. Lower clamp body 116 is formed with an arcuate projection 123 forming an arcuate slot or channel 124 with the front surface of clamp 116.

Upper clamp 117 is formed with a pair of holes 125 for receiving a pair of bolts 126 therethrough which extend through aligned holes 127 formed in lower clamp 116 for securing engagement with a pair of nuts 128 for clamping clamp members 116 and 117 together. Upper clamp 117 is formed with an arcuate projection 129 which forms an arcuate slot or channel 130 between projection 129 and the body of upper clamp 117. When clamp bodies 116 and 117 are clamped together by fasteners 126, arcuate channels 124 and 130 align and receive annular ring 41 therein, as shown in FIG. 6, to adjustably mount main body 35 on clamp mechanism 109 and subsequently on mounting bracket 108.

Handle 20 includes a cylindrical end section 22 which is attached to the end of hose 16 by a threaded engagement, adhesive, or other type of securement means to firmly attach handle 20 to the end of hose 16. Handle 20 further will include a reduced diameter nozzle end 24 terminating in an open end 26 through which dirt and other debris is collected by the vacuum imparted onto hose 16 during a cleaning operation. The opposite end of hose 16 will have an end seal 131 (FIGS. 4C and 16) secured thereto by a threaded engagement, adhesive, or other securement means.

Figure 17:
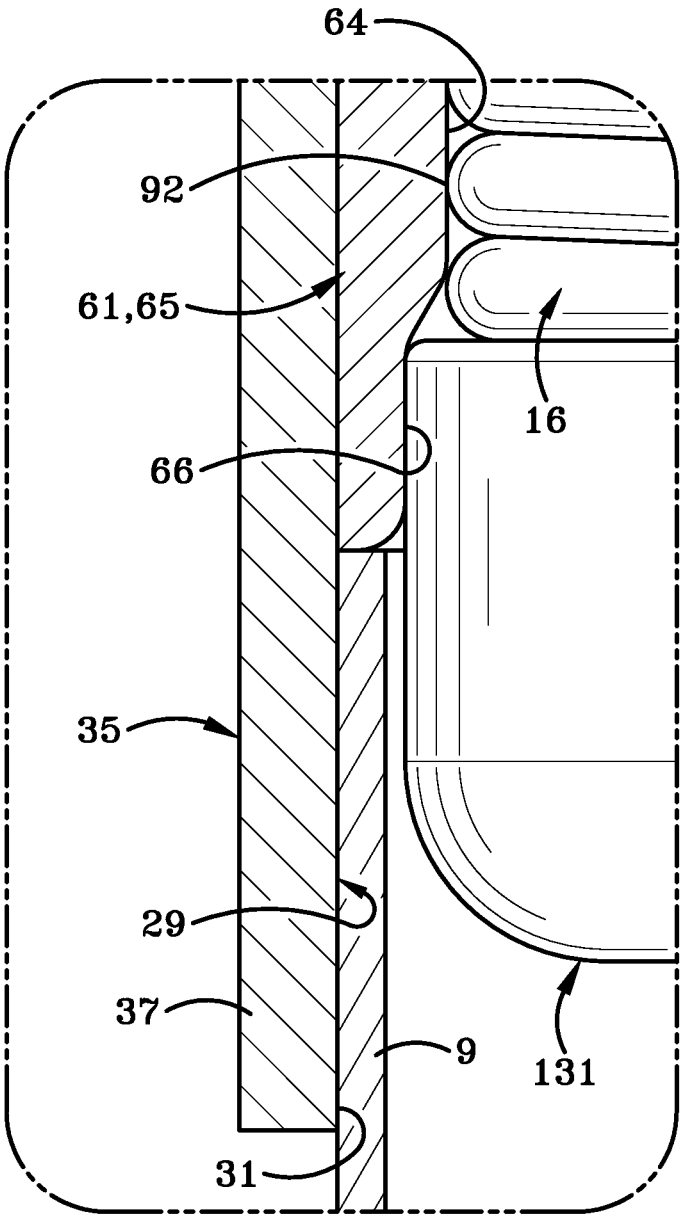
FIG. 17 is a greatly enlarged fragmentary view of the encircled portion of FIG. 16.

Hose end seal 131 is an annular ring formed having an internal bore generally complementary to the internal bore of hose 16 so as not to impede the vacuum flow. As best shown in FIGS. 16 and 17, the outer diameter of hose end seal 131 will be slightly smaller but complementary to the diameter of hose stop 61, but larger than the internal diameter of cylindrical body 65 of hose stop 61. This ensures that hose end seal 131 will not pull through locking collar 25 as shown in FIG. 16. Thus, as a user pulls hose 16 through the conduit, seal 131 will limit the outward movement of the hose by engagement of end seal 131 with the smaller diameter of hose stop 61.

FIGS. 1A, 2, 2A, 3 and 4C show collar 25 attached to a flexible conduit 23, and FIGS. 5-17 show collar 25 attached to a rigid conduit 9 for illustration purposes only. Either type of conduit will work equally well with collar 25.

As shown in FIG. 12, rigid conduit 9 is connected to locking collar 25, and in particular to main body 35 by slidingly inserting it into the end of cylindrical end section 37 where it abuts against the bottom edge of hose stop 61 pressing curved shoulder 63 thereof against annular shoulder 59. Hose stop 61 preferably is glued in position. Conduit 9 will be secured in end section 37 by an adhesive, threaded engagement, or other type of attachment well-known in the central vacuum cleaning art.

Flexible conduit 23 can be secured to locking collar 25 by a short section of rigid tube 133 and a coupler 134 preferably having a bell-shaped end 135 for receiving the end of hose 23 therein. It will also be secured by a threaded engagement, adhesive, or other type of attachment means as with rigid conduit 9. The inside diameter of conduits 9 and 23 is generally complementary to the outer diameter of hose end seal 131 in order to provide a sliding fit therebetween, as well as providing an air seal therebetween ensuring that the majority of the vacuum source is transmitted through the conduit and subsequently through the interior of hose 16 to achieve maximum dirt and debris pickup through the open end of handle 20 yet enabling hose 16 and end seal 131 to slide easily into and out of conduits 9 and 23.

Figure 2:
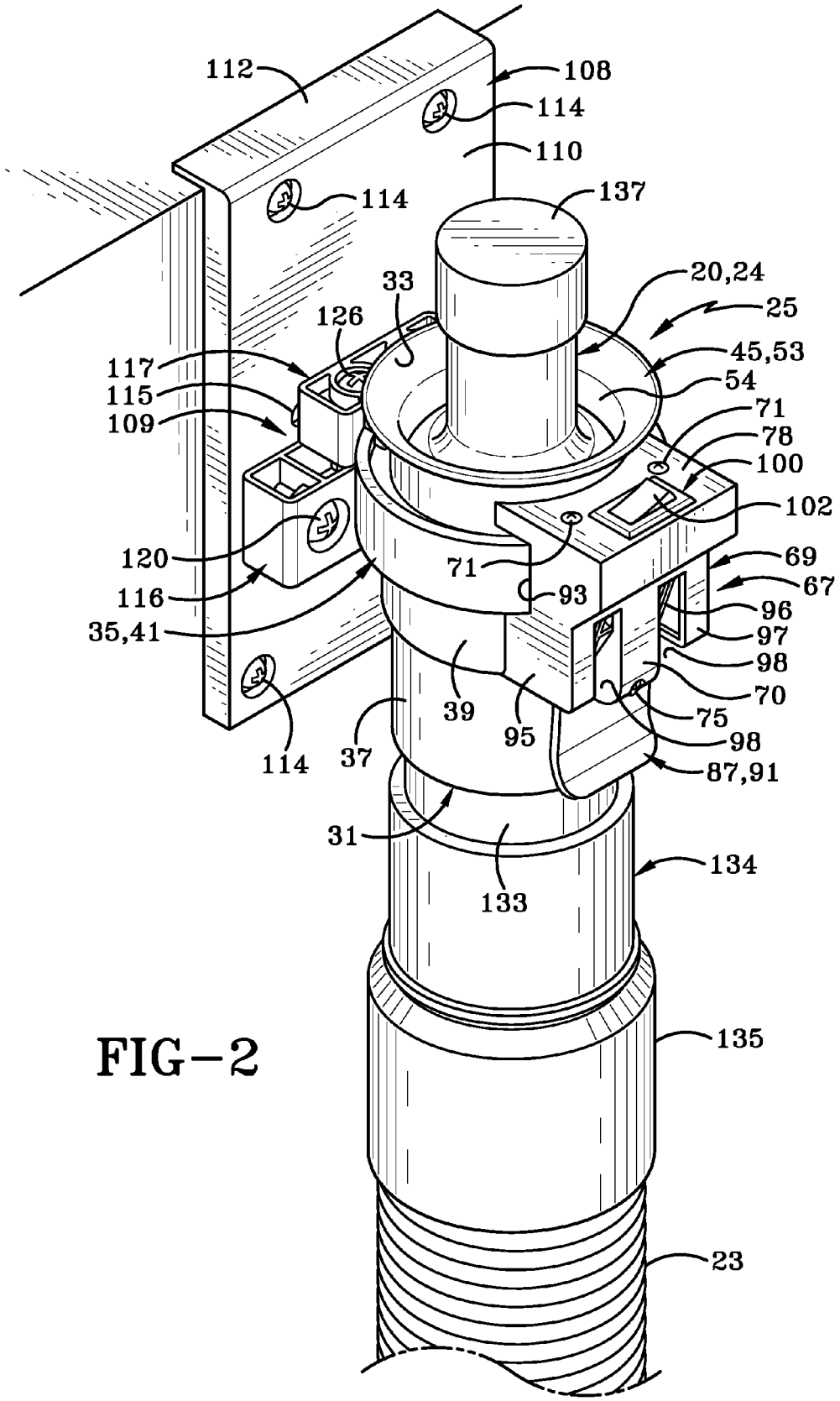
FIG. 2 is a top perspective view showing the vacuum tube locking collar mounted on a supporting structure with the cleaning hose in a fully retracted position within a flexible outer conduit as shown in FIG. 1A, and with an end sealing cap mounted on the end of the handle.
Figure 2A:
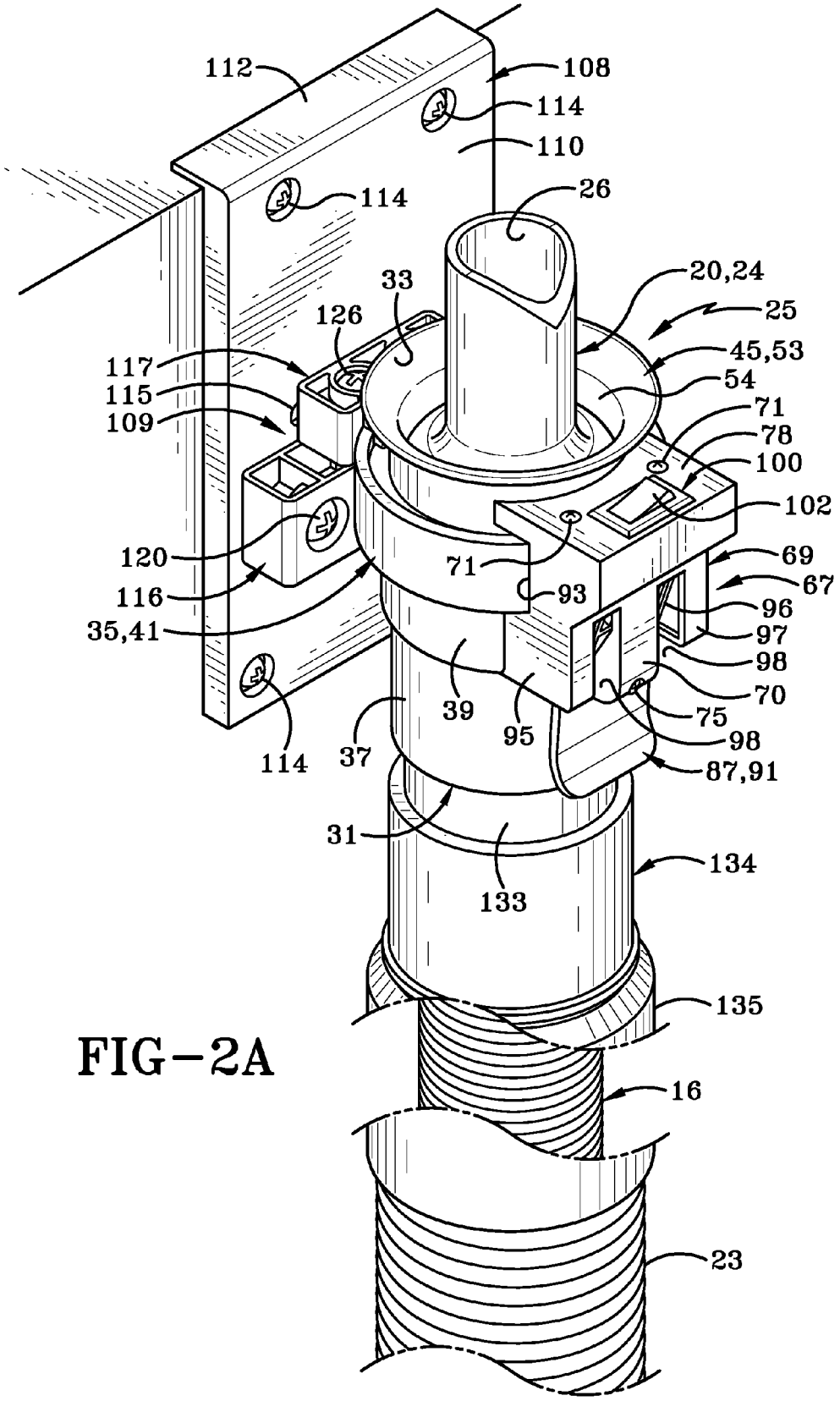
FIG. 2A is a top perspective view similar to FIG. 2 with portions broken away showing the locking collar of the present invention without the sealing end cap.
Figure 3:
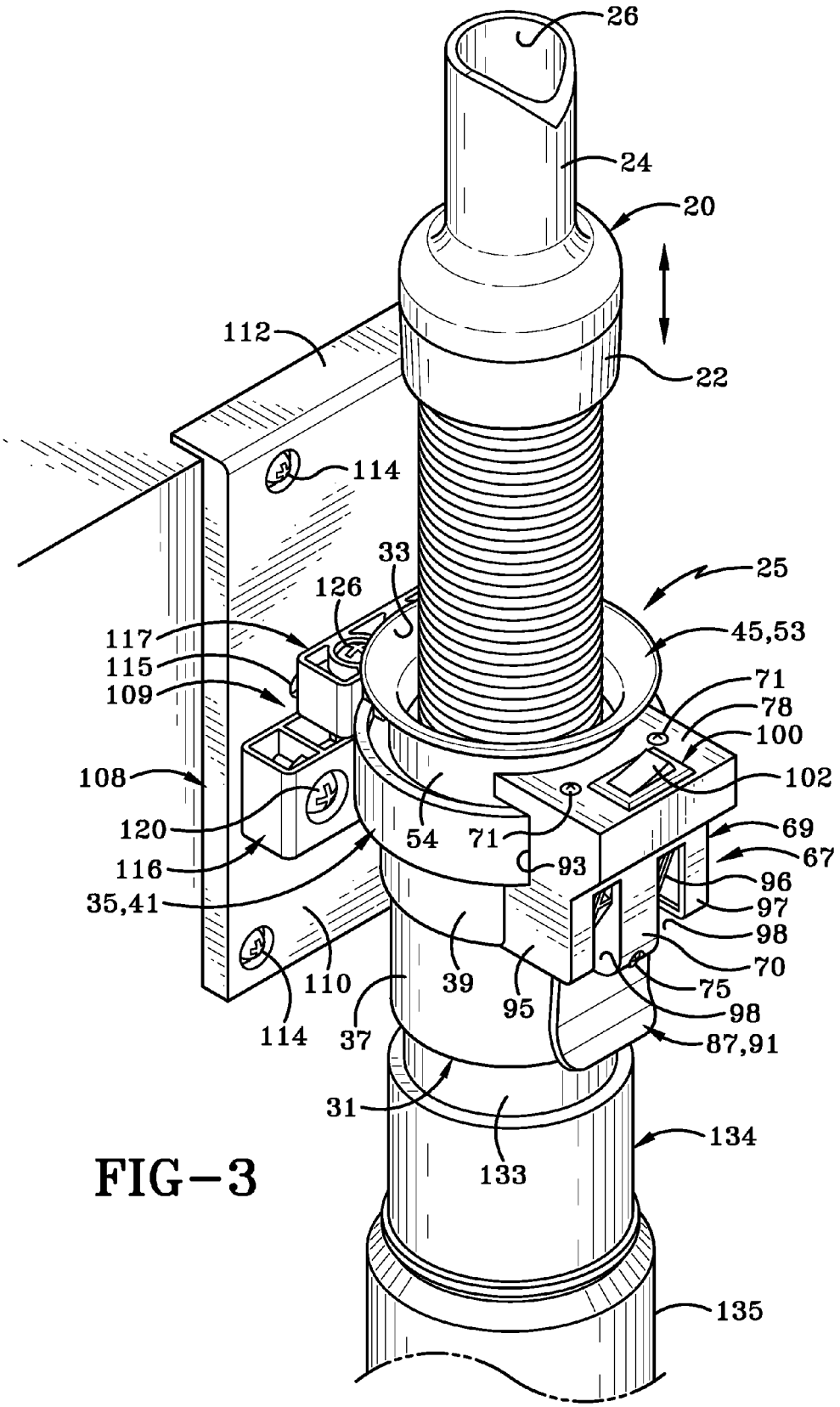
FIG. 3 is a top perspective view similar to FIG. 2 showing the cleaning handle removed from the collar and the internal hose in a partially extended position.

Locking collar 25 is installed easily in a structure or RV by first attaching mounting bracket 108 to a support structure by fasteners 114 which can be screws, bolts, rivets, or other type of fastener depending upon the nature of the support structure to which mounting bracket 108 is attached. Preferably, top flange 112 is placed against an edge of the supporting structure to align the mounting bracket thereon and enable it to be placed in a variety of locations within a structure. Bracket flange 112 can be placed horizontally on a structure as shown in FIG. 2A or can extend vertically along a structure edge (not shown) or in various other positions for subsequent attachment of collar 25 thereon.

Figure 8:
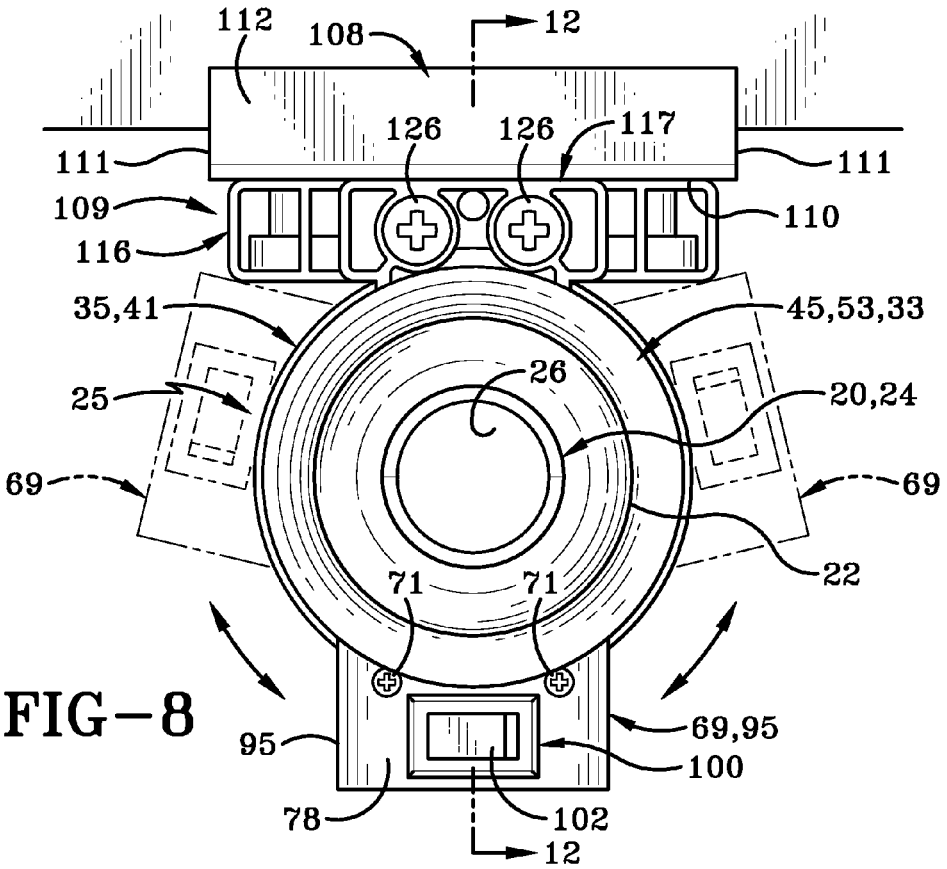
FIG. 8 is a top plan view showing the locking collar in three adjusted positions on the mounting bracket.
Figure 9:
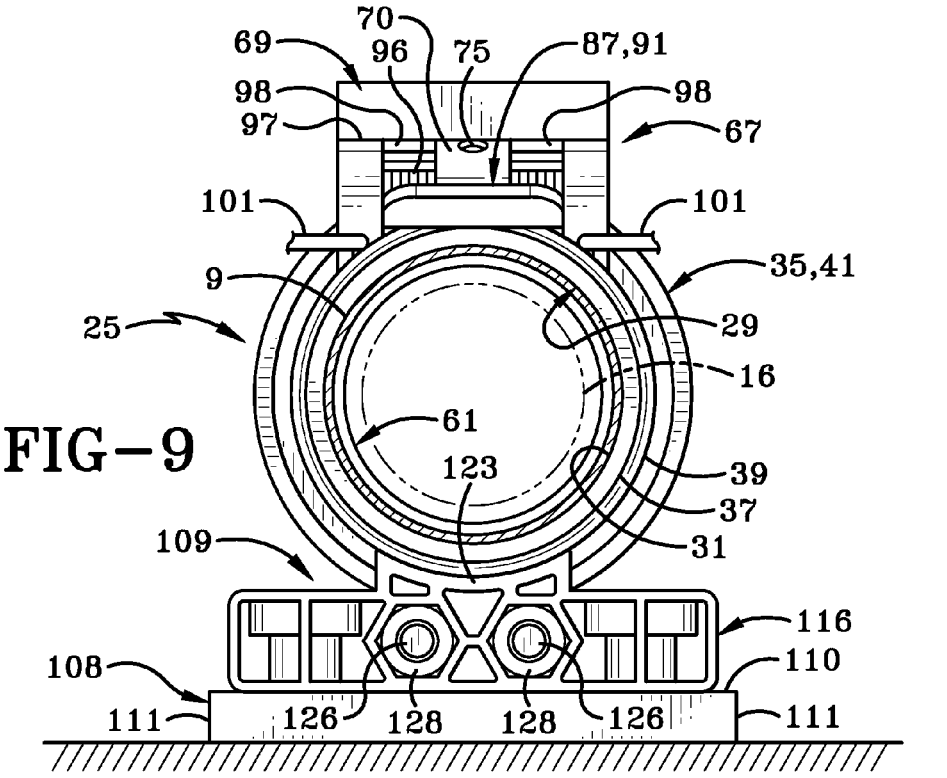
FIG. 9 is a sectional view taken along line 9-9, FIG. 5.

Lower clamp body 116 is attached to bracket plate 110 by inserting fasteners 120 through a pair of selected holes 115 and secured thereon by nuts 121. Main body 35 is mounted on lower bracket 116 by inserting the lower end of annular ring 41 within arcuate groove 124. Top body clamp 117 is placed in position with the top portion of ring 41 being seated within arcuate groove 130. Upper clamp body 117 is then secured on lower clamp body 116 by fasteners 126 and nuts 128. Initially, the clamping pressure exerted between clamp bodies 116 and 117 will be sufficient to secure ring 41 therebetween, yet loose enough to permit body 35 to be rotated with respect to mounting bracket 108 between various angular positions as shown in FIG. 8. After rotation of body 35 to the desired position, bolts 126 are then tightened to prevent further rotation of ring 41 within aligned channels 124 and 130. This feature enables body 35 to be adjusted to various angular positions on a supporting structure enabling it to be mounted at various locations and on various structures within a supporting structure, especially within an RV where spaced is limited. This adjustability will provide the best access for a user to pull handle 20 and attached hose 16 through collar 25 for a cleaning operation.

Figure 10:
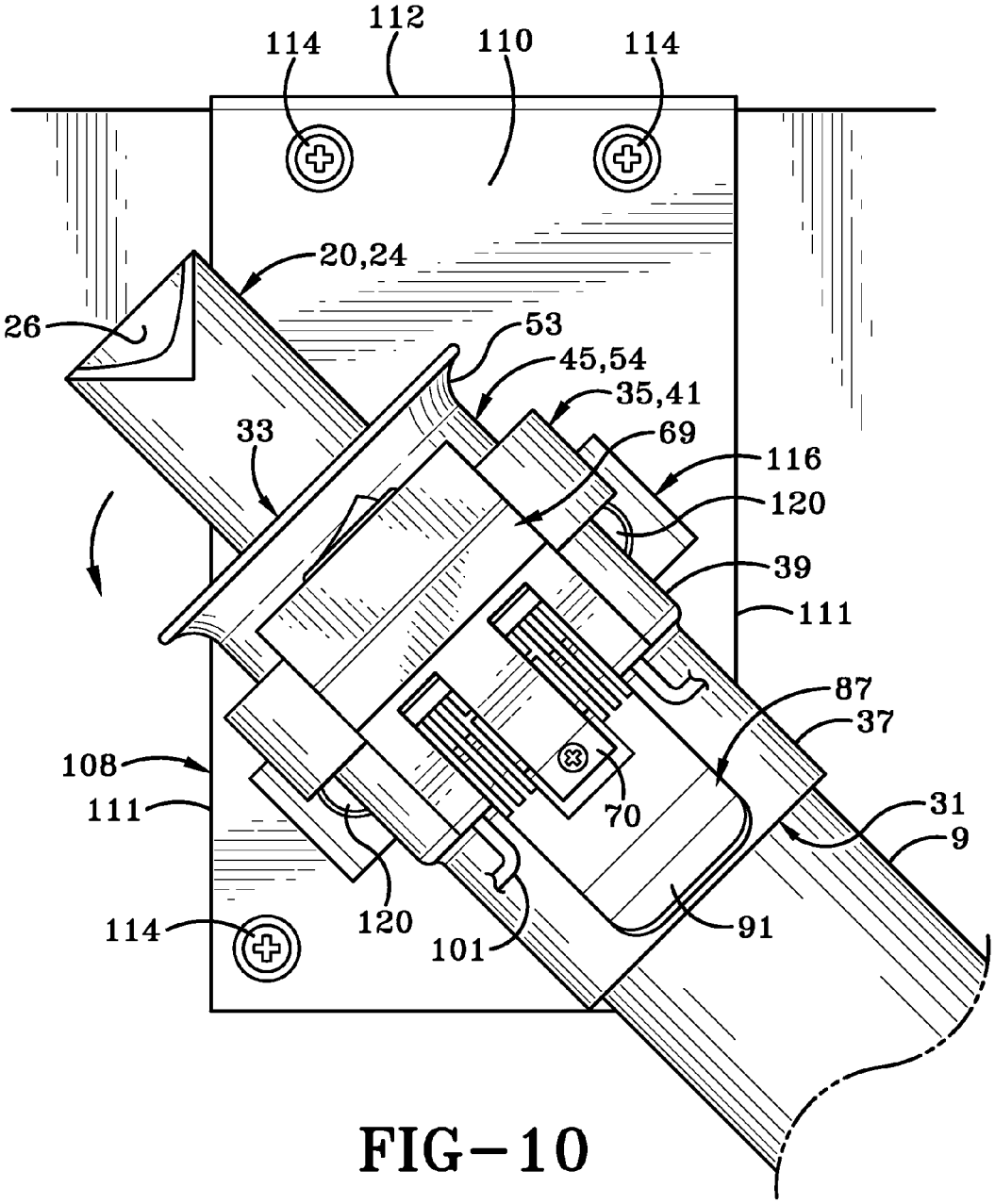
FIG. 10 is a view similar to FIG. 5 showing the locking collar and mounting clamps rotated 45° in a counterclockwise direction from its vertical position.
Figure 11:
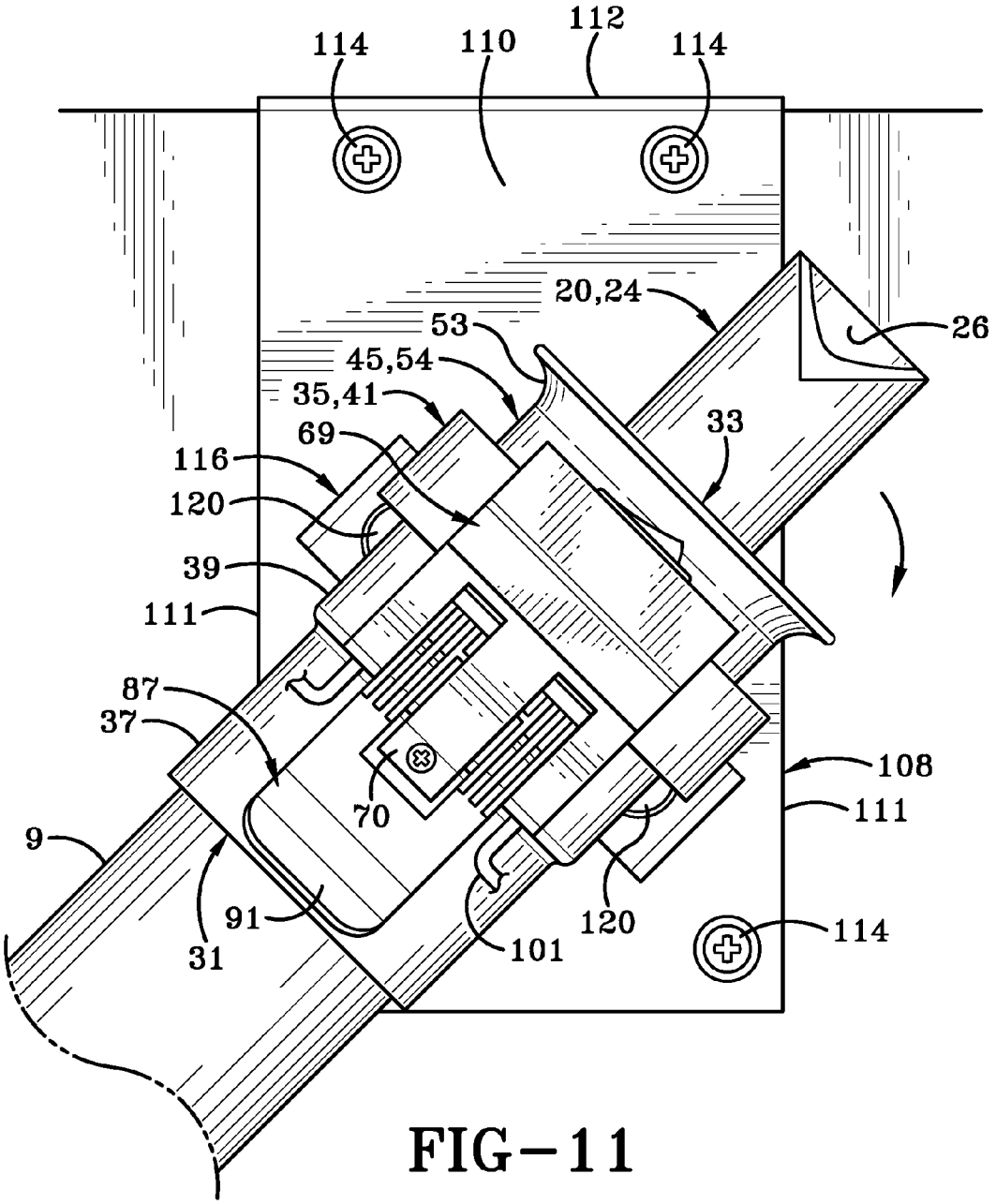
FIG. 11 is a view similar to FIG. 10 showing the locking collar and mounting clamps rotated 45° in the clockwise direction from the vertical position.

In accordance with another feature of the invention, which is especially helpful when mounting collar 25 in the narrow confines of an RV, is the ability to place valve body 25 at various angular positions on mounting bracket 108 as shown particular in FIGS. 7, 10, and 11. This is achieved by selecting an appropriate pair of holes 115 through which mounting bolts 120 will extend when mounting the clamp mechanism onto mounting bracket 108. As shown in FIG. 7, locking collar 25 is in a true vertical position and alignment with respect to the mounting plate as shown in FIGS. 5 and 6. However, it can easily be mounted in a variety of angular positions with respect to the mounting plate as shown in FIGS. 10 and 11, by merely selecting the appropriate holes on mounting bracket 108 for receiving bolts 120.

Another feature of clamp mechanism 109 is the ability to mount clamp bodies 116 and 117 directly onto a supporting structure by a pair of fasteners, such as screws, which will replace bolts 120 and extend directly through holes 119 into the supporting structure eliminating the need for bracket 108. Again, after securing bottom clamp body 116 to a supporting structure, top clamp body 117 is then secured thereto by bolts 126. It is readily apparent that bottom clamp member 116 can be mounted at various angles on a supporting structure, whether it extends vertically, horizontally, or on the side, top or bottom of a structure such as a cabinet or wall, afterwhich the angular position of the valve body can be adjusted thereon as shown in FIG. 8.

When a user wishes to use handle 20 for cleaning an area adjacent collar 25, he or she will manually pull outwardly on handle 20 extending hose 16 from within its stored position within conduits 9 or 23 to a desired length. Locking finger 87 will pivot freely in the direction of arrow A of FIG. 14 enabling hose 16 to slide past locking end 89 of finger 87 until the desired amount of hose is pulled from within the conduit. Locking finger 87 will pivot automatically in the direction of arrow B by the bias of spring 104 whereupon locking end 89 will automatically become engaged in a locking relationship within one of the valleys 90 formed between adjacent peaks 92 of hose 16. The operator can easily extend the hose further from within the conduit by merely pulling outwardly on the handle whereupon the lock finger will pivot out of locking engagement with hose 16 until the desired length is reached. Upon stopping this outward movement locking finger 87 will immediately assume another locked position within another valley 90. To unlock hose 16, the operator merely pivots locking finger 87 out of its locked position by manually moving finger tab 91 in the direction of arrow A of FIG. 14 to the unlocked position of FIG. 16. In this position, locking end 89 is removed from within its locked position with the hose. Finger 87 will remain in the unlocked position of FIG. 16 after being manually moved to this position by the biasing action of spring 104.

The hose will be automatically withdrawn into the interior of the conduit after unlocking finger 87 by the force of the vacuum or by a coil spring within the hose, which construction and action is well known in the vacuum cleaning art. Hose 16 can be a rigid non-expandable hose if desired, which also is easily retracted within the conduit by the vacuum force and by manually pushing the hose back into the conduit when a cleaning operation is completed. In a typical installation, hose 16 may have a length of approximately 7 feet and extendable to a length of approximately 30 feet. Locking collar 25 is easily adaptable for use with various types of cleaning hoses whether they be the expandable type with or without internal springs, or a more rigid non-expandable hose.

When collar 25 is used in a vacuum cleaning system having multiple inlets such as shown in FIG. 1, a sealing end cap 137 (FIG. 2) will be provided for manually placing over the open end 26 of handle 20. End cap 137 in combination with sealing ring 57 as shown in FIG. 12 sufficiently seals the vacuum in conduits 9 or 23, enabling the vacuum supply to maintain the vacuum on the other inlets as shown in FIG. 1. End cap 137 preferably will have a tether (not shown) either connected to mounting plate 108, handle 20 or collar 25. When collar 25 is used in a single inlet dedicated vacuum cleaning system as shown in FIG. 1A, no end cap 137 will be required.

In summary, the vacuum cleaning system and collar of the present invention enables the system to be installed in a usual dwelling with multiple vacuum inlets and particularly in an RV where space is at a premium. The collar can be mounted at various positions on a variety of supporting structures by a simple L-shaped mounting bracket 108 or directly by clamp members 116 and 117 which rotatably mount the collar body thereon enabling it to be rotated to a variety of positions. This adjustability of mounting the collar on the bracket in a variety of angular positions, as well as the rotational mounting of the collar body on the supporting clamp brackets enables the collar to match the available space and enables the user to easily grasp the handle therefrom when performing a cleaning operation.

The use of internal seal 57, together with end cap 137 enables the collar to be used in a multiple inlet vacuum cleaning system. The incorporation of switch 100 in the locking mechanism housing provides a readily accessible means of turning the vacuum system ON and OFF. Likewise, ring 55 provides a retention mechanism to assist in retaining handle 20 within the collar as shown in FIG. 12 in addition to assisting the vacuum seal therewith. Again, the rotational mounting of the collar body offers a wide degree of installation versatility while still securely holding the handle in a stored position, and the selective mounting of the clamp members on the bracket and the L-shaped configuration of the bracket and multiple mounting holes allows installation at various angular orientations and on various supporting structures, especially in an RV where space is at a premium.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the preferred embodiment of the invention are an example and the invention is not limited to the exact details shown or described.

The invention claimed is:

1. A central vacuum cleaning system comprising:

a vacuum source;

a vacuum conduit extending from the vacuum source to an inlet end;

a hose slidably mounted within the conduit and extendable from a retracted position to an extended position having a first end operatively communicating with the vacuum source and a second end extendable from the inlet end of the conduit for collecting debris from an area to be cleaned;

a handle on the second end of the hose;

a collar adapted to be mounted on a supporting structure at the inlet end of the conduit and connected to the vacuum conduit permitting passage of the hose therethrough and for holding the handle in a stored position when the hose is in the retracted position;

a locking mechanism on the collar permitting the hose to move freely toward the extended position through the collar while preventing movement of the hose toward the retracted position until manually actuated by a user;

said locking mechanism including a lock housing mounted on the collar, a locking finger having first and second ends pivotally mounted within the lock housing and moveable between first and second positions, said first end being releasably engageable with the hose when the finger is in the first position and the second end being manually manipulated by a user for moving the first end of the finger out of engagement with the hose and placing the finger into the second position; and a clamp mechanism adjustably mounting the collar on the support structure at the inlet end of the conduit.

2. The system defined in claim 1 in which the collar includes a collar body having a cylindrical end attached to the vacuum conduit; a central section for receiving a portion of the handle; and a flared outer end for guiding the handle into the collar body when the hose is moving toward the retracted position.

3. The system defined in claim 1 including a spring operatively engageable with the locking finger biasing the first end of the finger toward locking engagement with the hose when in the first position and for maintaining the first end out of locking engagement with the hose when the finger is in the second position.

4. The system defined in claim 1 in which the hose is provided with a series of peaks and valleys along its length; and in which the first end of the locking finger is selectively engageable with one of said peaks and valleys to releasably lock the hose in an extended position.

5. The system defined in claim 1 wherein a switch is mounted within the lock housing and is electrically connected to the vacuum source for turning said vacuum source ON and OFF.

6. The system defined in claim 1 in which the collar body has a cylindrical interior bore; and in which at least one O-ring is mounted within the cylindrical bore and provides a friction fit between the collar body and handle to assist in retaining the handle in the stored position.

7. The system defined in claim 1 including an end cap for sealing an open end of the handle when the handle is in the stored position in the collar.

8. The system defined in claim 1 wherein the collar includes a body; in which a ring is formed on and extends at least partially around the body; and in which the clamp mechanism includes a pair of clamp members engageable with the ring for adjustably mounting the body on the clamp mechanism and for securing the annular body on the support structure.

9. The system defined in claim 1 wherein the vacuum conduit is a flexible hose extending from the vacuum source to a rigid coupling attached to the collar.

10. The system defined in claim 1 including a stop ring mounted on the first end of the hose providing a sliding air seal with the conduit and engageable with a stop ring mounted within the collar to stop the first end of the hose from moving through the collar.

11. The system defined in claim 1 including a mounting bracket formed with a first plurality of mounting holes for receiving a first plurality of fasteners to secure the bracket to a supporting structure; and in which a second plurality of attachment holes are formed in the bracket for receiving a second plurality of fasteners for attaching the clamp mechanism on the mounting bracket for adjustably mounting the collar on the bracket.

12. The system defined in claim 1 in which the handle has an annular terminal edge; in which an annular sealing ring is mounted within the collar; and in which the terminal edge of the collar seats upon the sealing ring when the hose is in the retracted position to provide an air seal with the conduit.

13. A collar adapted to be mounted on a structure and connected to a terminal end of a conduit of a vacuum cleaning system comprising:

a body formed with a through bore with inner and outer open ends, said inner open end adapted to communicate with the conduit and the outer end adapted to receive a handle attached to an end of a hose expandable from and retractable within the conduit when the handle is in a stored position in the collar;

a locking mechanism on the body including a locking member extending into the bore for automatically engaging the hose to maintain the hose in an extended position until manually released to permit the hose to return to a retracted position within the conduit;

a seal within the body adapted to provide an air seal between the handle and collar when the handle is in the stored position;

an annular ring formed on and extending at least partially around the body; and a pair of clamp members engageable with the ring for rotatably mounting the body on the clamp members and for mounting the collar on a support structure.

14. The collar defined in claim 13 in which the collar body is a one-piece member formed of plastic; in which the body has a first cylindrical end section for receiving an end of the conduit and a second cylindrical section in communication with the locking mechanism and a third cylindrical section terminating in a flared outer end for guiding the handle into the collar body.

15. The collar defined in claim 13 in which the locking mechanism includes a housing mounted on the collar body; in which the locking member is pivotally mounted within the housing and is moveable between a locking position and an unlocked position, said locking member having a first end adapted to releasably engage the hose when in the locking position and a second end for manual manipulation by a user for moving the first end of the member out of locking engagement with the hose.

16. The collar defined in claim 15 in which a spring is operatively engageable with the locking member biasing the first end of the locking member toward the locking position and for maintaining the locking member in the unlocked position when manually placed in said unlocked position.

17. The collar defined in claim 13 in which each of the clamp members is formed with a curved channel which align with each other; and in which the ring is slidably mounted within the aligned channels.

18. The collar defined in claim 13 including a mounting bracket formed with a plurality of mounting holes for receiving a first plurality of fasteners to secure the bracket to a supporting structure; and in which the bracket is formed with a second plurality of holes for receiving a second plurality of fasteners for attaching the clamp members on the mounting bracket for adjustably mounting the collar on the bracket.

19. The collar defined in claim 13 in which the locking mechanism includes a lock housing mounted on the collar pivotally mounting the locking member therein; and in which a switch is mounted in the lock housing for electrically connecting to a vacuum source for turning said vacuum source ON and OFF.

20. The collar defined in claim 13 wherein the seal includes a first O-ring for slidably receiving the handle therethrough and a second O-ring for supporting an end of the handle when the handle is in the stored position.

21. A central vacuum cleaning system comprising:

a vacuum source;

a vacuum conduit extending from the vacuum source to an inlet end;

a hose slidably mounted within the conduit and extendable from a retracted position to an extended position having a first end operatively communicating with the vacuum source and a second end extendable from the inlet end of the conduit for collecting debris from an area to be cleaned;

a handle on the second end of the hose;

a collar adapted to be mounted on a supporting structure at the inlet end of the conduit and connected to the vacuum conduit permitting passage of the hose therethrough and for holding the handle in a stored position when the hose is in the retracted position, said collar including a body having a ring formed on and extending at least partially around the body;

a locking mechanism on the collar permitting the hose to move freely toward the extended position through the collar while preventing movement of the hose toward the retracted position until manually actuated by a user; and a clamp mechanism adjustably mounting the collar on the support structure at the inlet end of the conduit, said clamp mechanism including a pair of clamp members engageable with the ring for adjustably mounting the body on the clamp mechanism and for securing the body on the support structure, said clamp members being formed with a curved channel which align with each other, said ring being slidably mounted within the aligned channels for adjustably mounting the body on the clamp mechanism.

* * * * *